United States Patent [19]

Menia

[11] 4,131,255

[45] Dec. 26, 1978

[54] RAIL SWITCH ARRANGEMENT

[75] Inventor: Manfred Menia, Hard, Austria

[73] Assignee: Heinz Faigle, Hard, Austria

[21] Appl. No.: 765,543

[22] Filed: Feb. 4, 1977

[30] Foreign Application Priority Data

Feb. 9, 1976 [AT] Austria ..... 877/76
Oct. 14, 1976 [AT] Austria ..... 7670/76

[51] Int. Cl.[2] ..... E01B 7/00
[52] U.S. Cl. ..... 246/430; 246/434
[58] Field of Search ..... 246/415 R, 430, 380, 246/392, 273, 434; 104/130, 131, 132, 102, 103; 308/3 C, 6 R, 239, DIG. 6, 3 R, 7, 238; 238/122, 150

[56] References Cited

U.S. PATENT DOCUMENTS

| | | | |
|---|---|---|---|
| 3,093,090 | 6/1963 | Rosenbaum | 246/434 |
| 3,243,236 | 3/1966 | Graham | 308/238 |
| 3,390,854 | 7/1968 | Sherburne | 308/3 R |
| 3,737,657 | 6/1973 | Dohse | 246/392 |
| 4,006,505 | 2/1977 | Köster | 308/3 R |

FOREIGN PATENT DOCUMENTS

| | | | |
|---|---|---|---|
| 2047760 | 5/1972 | Fed. Rep. of Germany | 246/430 |

*Primary Examiner*—Trygve M. Blix
*Assistant Examiner*—Reinhard J. Eisenzopf
*Attorney, Agent, or Firm*—Hans Berman

[57] ABSTRACT

In a rail switch arrangement in which an elongated rail is fixedly mounted on supporting structure and an elongated rail blade is moved on the supporting structure toward and away from a position contiguously adjacent the fixedly mounted rail, a sheet member of synthetic resin composition is fixedly secured to a bottom face of the rail blade and slidingly engages the approximately horizontal top face of the supporting structure during the movement of the rail blade.

10 Claims, 17 Drawing Figures

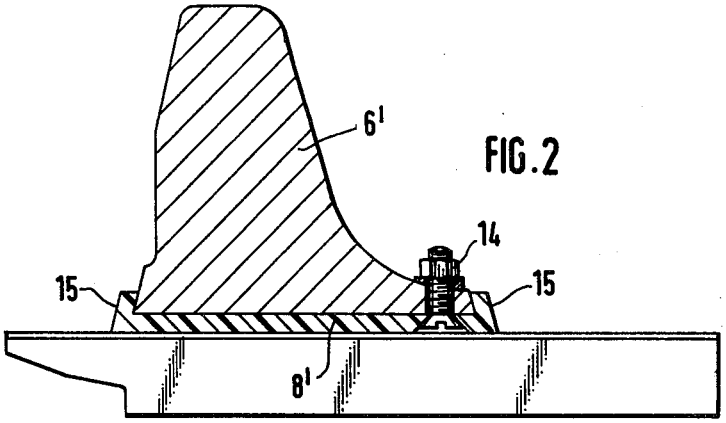
FIG.2
FIG.3
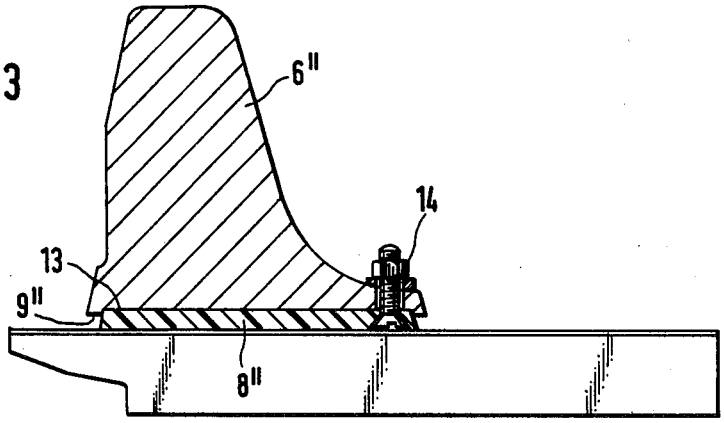
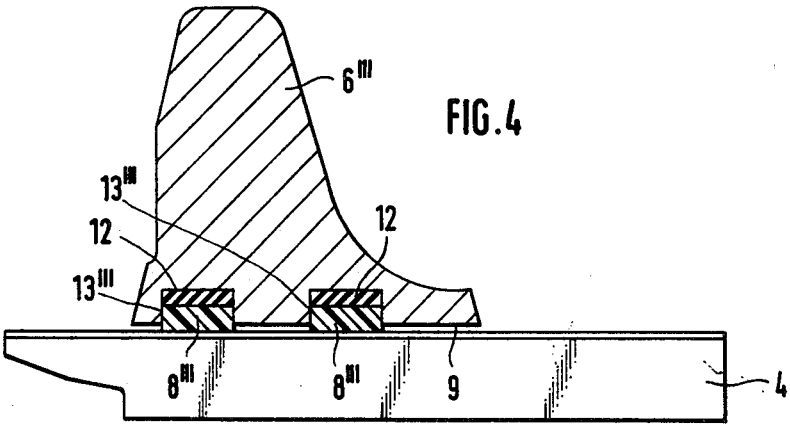
FIG.4

RAIL SWITCH ARRANGEMENT

This invention relates to railroad rails, and more particularly to a switch arrangement in which a pair of blades are moved simultaneously on a common support structure toward and away from a pair of fixedly mounted rails, and particularly to an improvement in the bearing slidably connecting the rail blades to the supporting structure, such as ties.

It has been common practice to mount a slide plate on the ties of a switch under each rail blade, and to move the rail blade toward and away from the associated fixed rail in sliding contact with the slide plate. Lubrication of the interface between the engaged metal surfaces of a slide plate and of a rail blade is necessary, but not readily maintained.

It was proposed heretofore to equip the top face of the slide plate with a coating of a synthetic resin composition or plastic having a low coefficient of friction in contact with the steel of the rail blade, but such an arrangement has not been fully satisfactory. The upwardly directed plastic surface is exposed to sunlight and collects contaminants from the atmosphere. All plastics presently available and otherwise suitable deteriorate under ultraviolet radiation and are not fully resistant to atmospheric corrosion. At temperatures below freezing, ice coating a slide plate must be thawed, and it is customary to use gas torches for the purpose. They cannot be used on plasticcovered slide plates, and alternative heating systems are costly to build and to operate. A metal in contact with a plastic surface should be as hard as possible for low friction. Rail blades in switches are rolled steel sections of relatively low hardness, and it is not practical to harden their bottom faces. Because of these shortcomings, plastic coatings on slide plates to railroad switches did not find wide acceptance although they have obvious advantages.

It has now been found that the inherent advantages of frictional engagement between plastic and steel can be maintained fully, and the difficulties enumerated above can be avoided by coating the bottom face of the rail blade with a sheet of plastic. In this location, the plastic is fully protected against sunlight and any contaminants dropping from the atmosphere. The relatively small amount of metal in the slide plate may be selected for maximum hardness much more freely than the rail blade which undergoes a variety of stresses in normal service while the slide plate is stressed in compression only. A slide plate also is readily case hardened or otherwise provided with a hard surface coating in a manner not practical in rail blades. Because ice forms in winter on the metallic top face of the slide plate, but not on the plastic coated bottom face of the rail blade, the switch of the invention may be de-iced in the preferred manner by means of a gas torch.

Other features, additional objects, and many of the attendant advantages of this invention will readily be appreciated as the same becomes better understood by reference to the following detailed description of preferred embodiments when considered in connection with the appended drawing in which:

FIG. 1 shows a switch arrangement of the invention in fragmentary front-elevational section;

FIGS. 2 to 5 inclusive, 7, 9, 11, and 13 illustrate modified rail blades and cooperating slide plates for use in the switch arrangement of FIG. 1 in respective corresponding views;

FIGS. 6, 8, and 10 are respective, fragmentary bottom plan views of the rail blades of FIGS. 5, 7, and 9;

Figure 1:
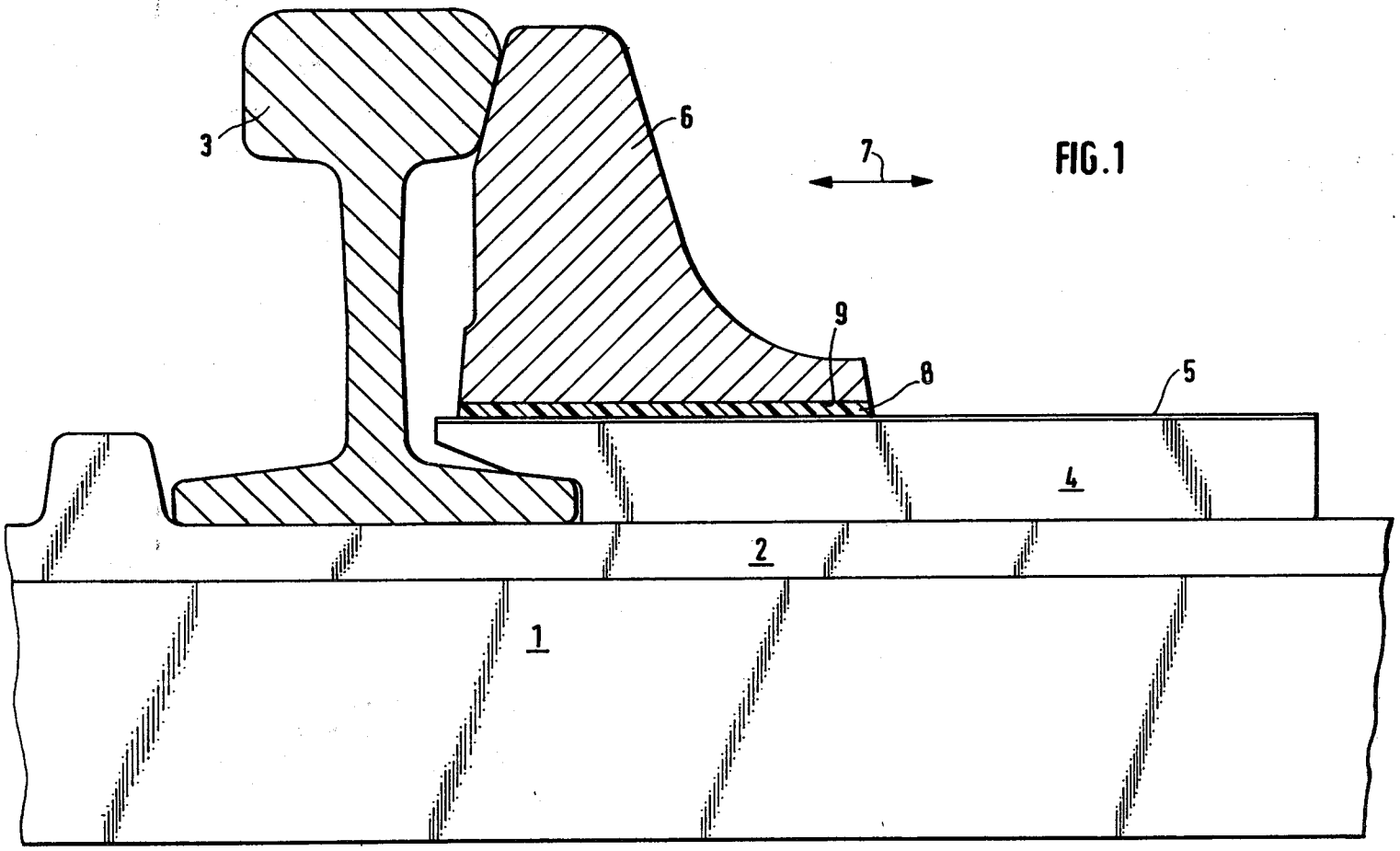

Referring now to the drawing in detail, and initially to FIG. 1, there is shown only as much of an otherwise conventional switch in a railroad track as is needed for an understanding of the invention, only one stationary rail 3 and one movable rail blade 6 being seen in section at right angles to their common direction of elongation. The structure shown in FIG. 1 is duplicated in mirror image on the side of the track omitted from FIG. 1.

The rail 3 is fixedly fastened to a wooden tie 1 by means of a steel mounting plate 2 and bolts not specifically illustrated. The rail blade 6 is movably supported on the smooth, horizontal top face 5 of a slide plate 4 which in turn is fixed to the mounting plate 2 in a conventional manner, not shown. The blade 6 may be moved horizontally toward and away from the illustrated position contiguously adjacent the fixed rail 3 in the manner indicated by a double arrow 7 by means of a stretcher bar and a manual switch box, as is conventional and not shown.

Movement of the rail blade 6 on the top face 5 of the supporting structure, that is, the tie 1, mounting plate 2, and slide plate 4, is facilitated by a sheet 8 of synthetic polyamide resin composition adhesively fastened to the flat, horizontal bottom face 9 of the rail blade 6. The upwardly directed surface of the sheet 8 is shielded against the radiation of the sun and against atmospheric contaminants by the rail blade 6, and the downwardly directed plastic surface is protected almost as effectively by the top surface 5 of the slide plate 4.

The rail blade 6 is moved only when not weighted by a railroad car, and adhesive may fasten the sheet 8 to the face 9 of the blade 6 with sufficient strength if the blade is relatively light and is moved at a relatively slow rate by the afore-mentioned manual switch box. More elaborate fastening devices are preferred for very heavy rail blades and for electrically operated switches.

The plastic sheet 8′ shown in FIG. 2 is provided with upturned flanges 15 elongated at right angles to the plane of the drawing, and thus in the direction of elongation of the blade 6′. The base of the rail blade 6′ is conformingly received between the flanges 15, and the sheet 8′ is further anchored to the blade 6′ by means of a bolt recessed in the sheet 8′ and a nut 14. While the flanges 15 are exposed, they are not subjected to major operating stresses, and their strength is not as critical as that of the slidingly engaged bottom face of the sheet 8′.

Exposed flanges are avoided in the arrangement illustrated in FIG. 3 in which the bottom face 9″ of the rail blade 6″ is provided with a shallow recess 13 partly receiving and further protecting a flat plastic sheet 8″ which is held in position by the rim of the recess 13 and a bolt and nut as described with reference to FIG. 2.

The plastic sheet need not be coextensive with the entire bottom face portion of the rail blade which sweeps the slide plate in the manner illustrated in FIGS.

2 and 3. The rail blade 6''' seen in FIG. 4 is provided with two longitudinal rows of spaced recesses 13''' in its bottom face 9''', only one recess of each row being shown. A rectangular plastic plug 8''' of sheet material is received in each recess 13''', and is backed vertically by a cushion 12 of synthetic rubber. The resiliency of each cushion is chosen in such a manner that the weight of the blade 6''', cannot push the plugs 8''' fully into the recesses 13''' so that the blade travels only on the plastic surfaces when being moved. When a train passes over the switch, the plugs 8''' are fully retracted into the recesses 13''', and the weight of the train is directly transmitted from the metal of the blade 6''' to the metal and wood of the supporting structure.

Figure 5:
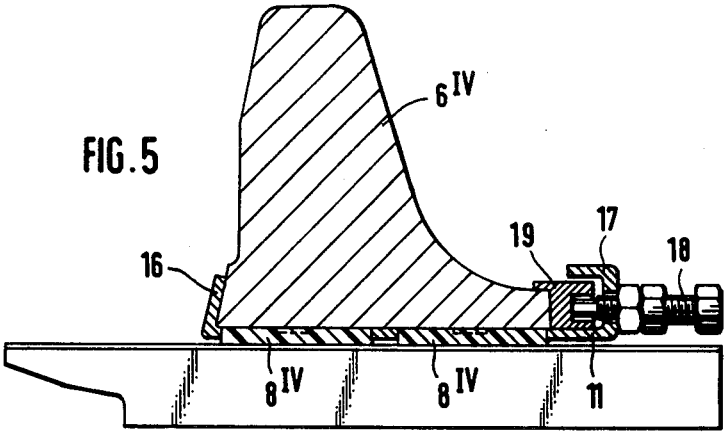
Figure 6:
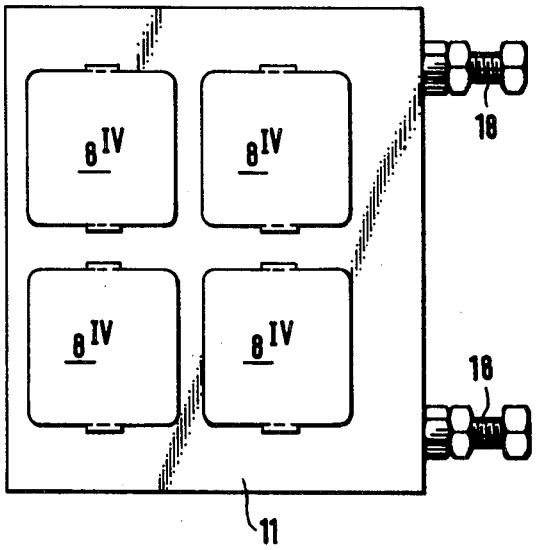

When it is inconvenient or too costly to form the recesses 13''' in the rail blade 6''', or when the resulting weakening of the blade is not acceptable, closely analogous results are achieved with the arrangement illustrated in FIGS. 5 and 6. A sheet metal frame 11 has two upturned flanges 16, 17 between which the base of the rail blade $6^{IV}$ is received with ample clearance. Clamping screws 18 in the flange 17 press a shoe 19 against the blade $6^{IV}$, and thus against the flange 16 so that the frame 11 is firmly fastened to the bottom face of the blade. Four spaced apertures passing between the major faces of the frame 11 receive respective sheets $8^{IV}$ of synthetic resin composition. The sheets project downward from the frame 11 for sliding engagement with the top face of the associated slide plate.

Figure 7:
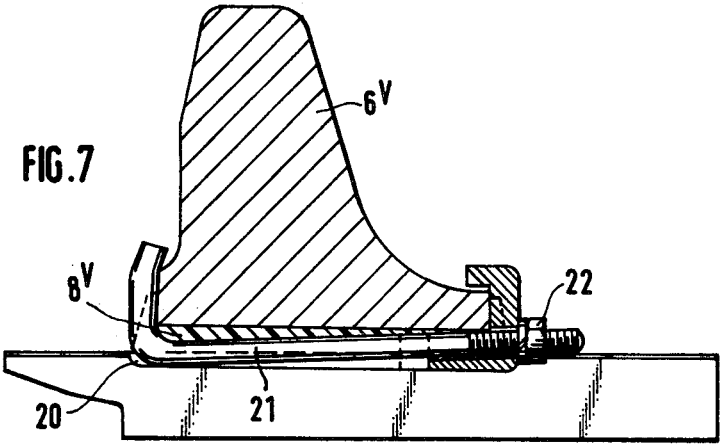
Figure 8:
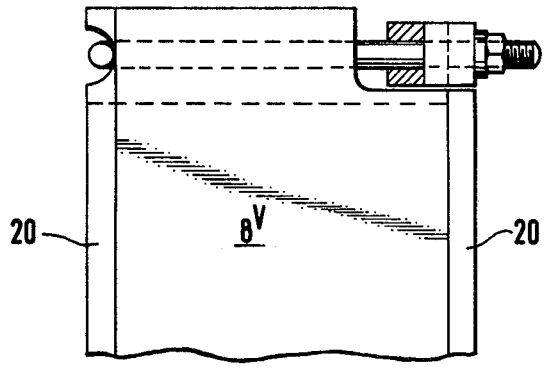

A frame of the general type shown at 11 in FIGS. 6 and 7 may be secured longitudinally of the associated rail blade in a manner shown in FIGS. 7 and 8. Longitudinal flanges 20 conformingly envelop the base of the rail blade $6^{V}$, and also prevent slipping of a plastic sheet $8^{V}$ in the direction of blade movement. An approximately L-shaped, partly threaded steel rod 21 of circular cross section passes through openings in each of the two longitudinal ends of the flanges 20, only one rod 21 and associated elements being seen in the drawing. One end of each rod 21 is secured by the shorter leg of the L-shape, and the other end by a clamping nut 22. Each rod 21 abuts against a vertical end face of the associated slide plate and thereby secures the longitudinal position of the sheet $8^{V}$.

Figure 9:
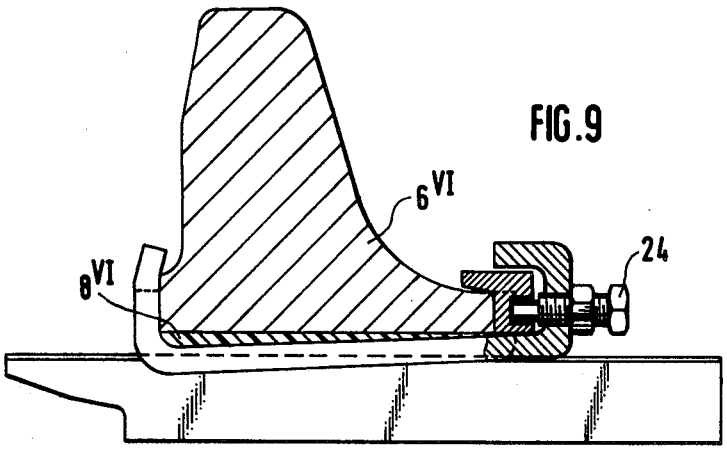
Figure 10:
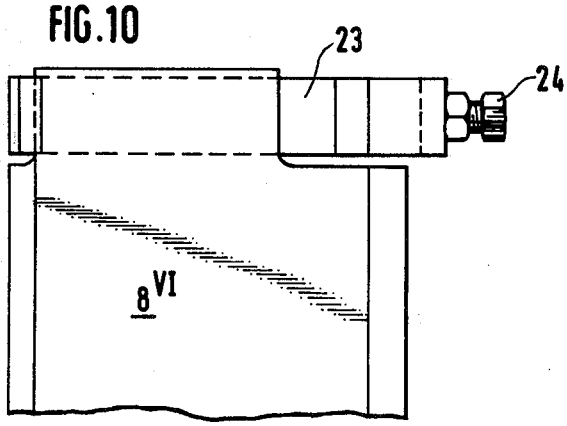

The device illustrated in FIGS. 9 and 10 differs from the structure described with reference to FIGS. 7 and 8 mainly by the substitution of flat steel bars 23 for the rods 21. A plastic sheet $8^{VI}$ is secured to the bottom face of a rail blade $6^{VI}$ by a metal frame which in turn is fastened to the rail blade by its flanges, by clamping screws 24, and by the bars 23.

Figure 11:
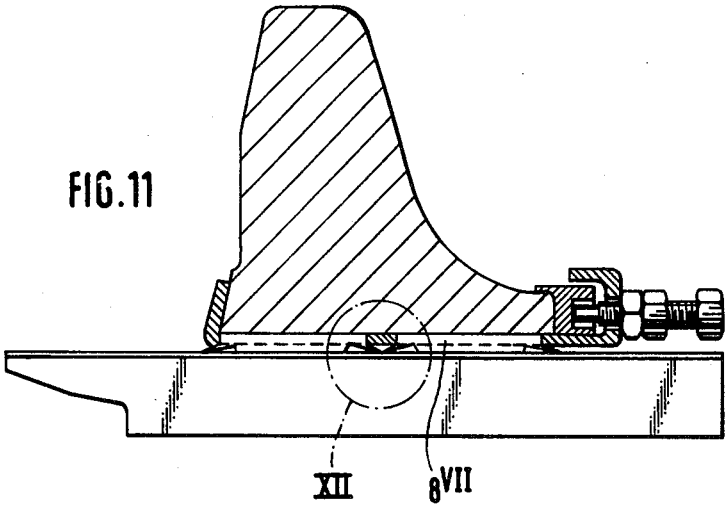
Figure 12:
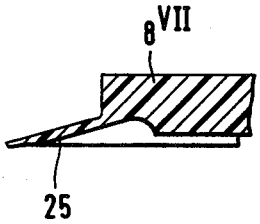
FIG. 12 is an enlarged view of a detail indicated in FIG. 11 by a circle XII.

FIGS. 11 and 12 illustrate a modification of the device described above with reference to FIGS. 5 and 6. The four plastic sheets $8^{VII}$ which replace the aforedescribed sheets $8^{IV}$ have reduced, resilient wiper portions 25 longitudinal relative to the associated rail blade which terminate in narrow lips sweeping the top face of the supporting structure free of particulate contaminants during nomral operating movement of the rail blade.

Figure 13:
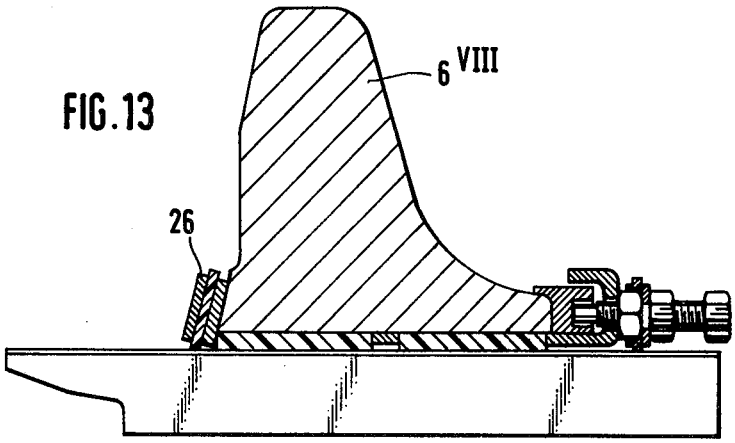
Figure 14:
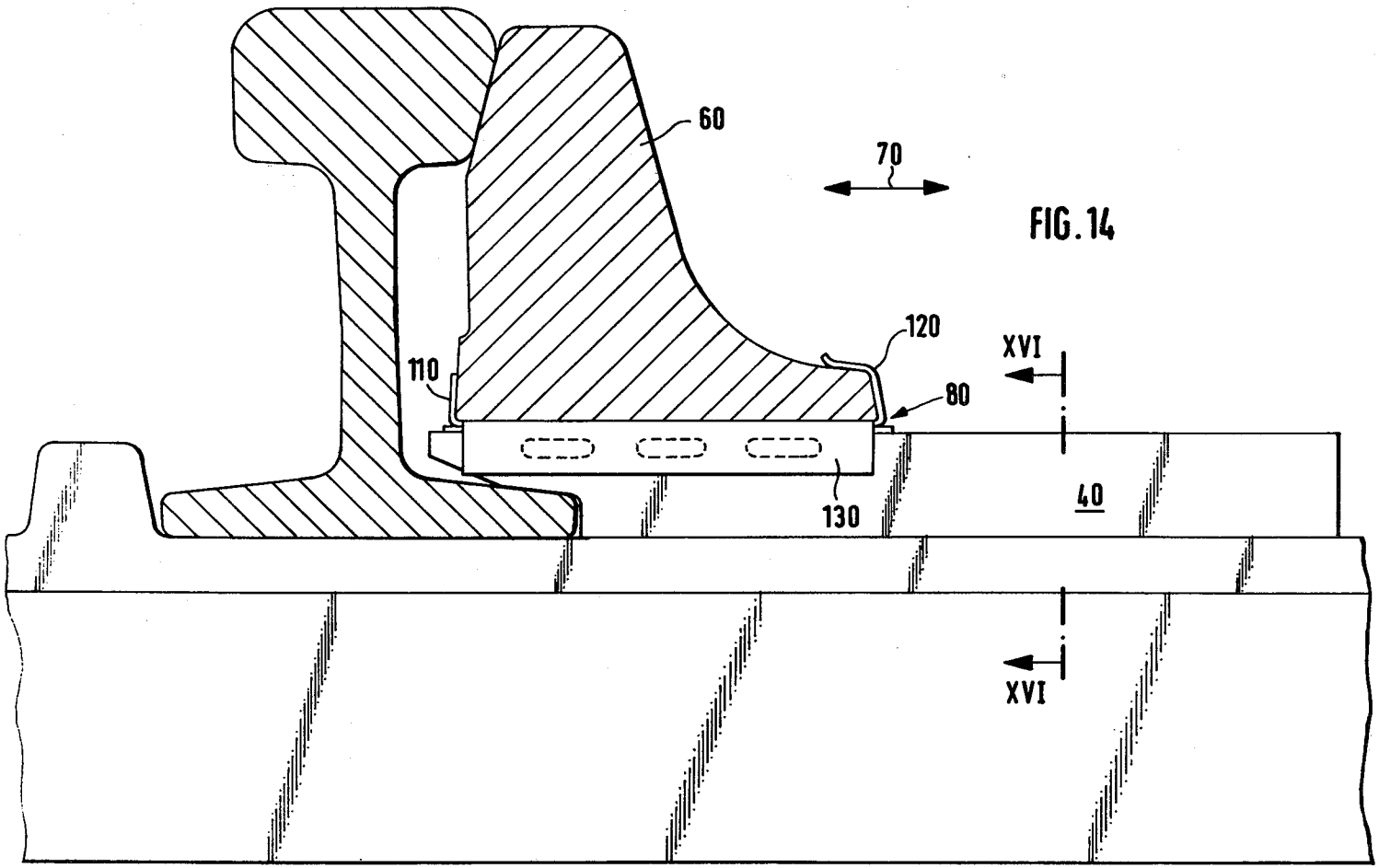
FIG. 14 illustrates another switch arrangement of the invention in fragmentary front-elevational section.

As is shown in FIG. 13, the otherwise unchanged device of FIGS. 5 and 6 may also be provided with a separate, resilient wiper blade 26 attached to the metal of the rail blade $6^{VIII}$ for the same purpose.

Figure 15:
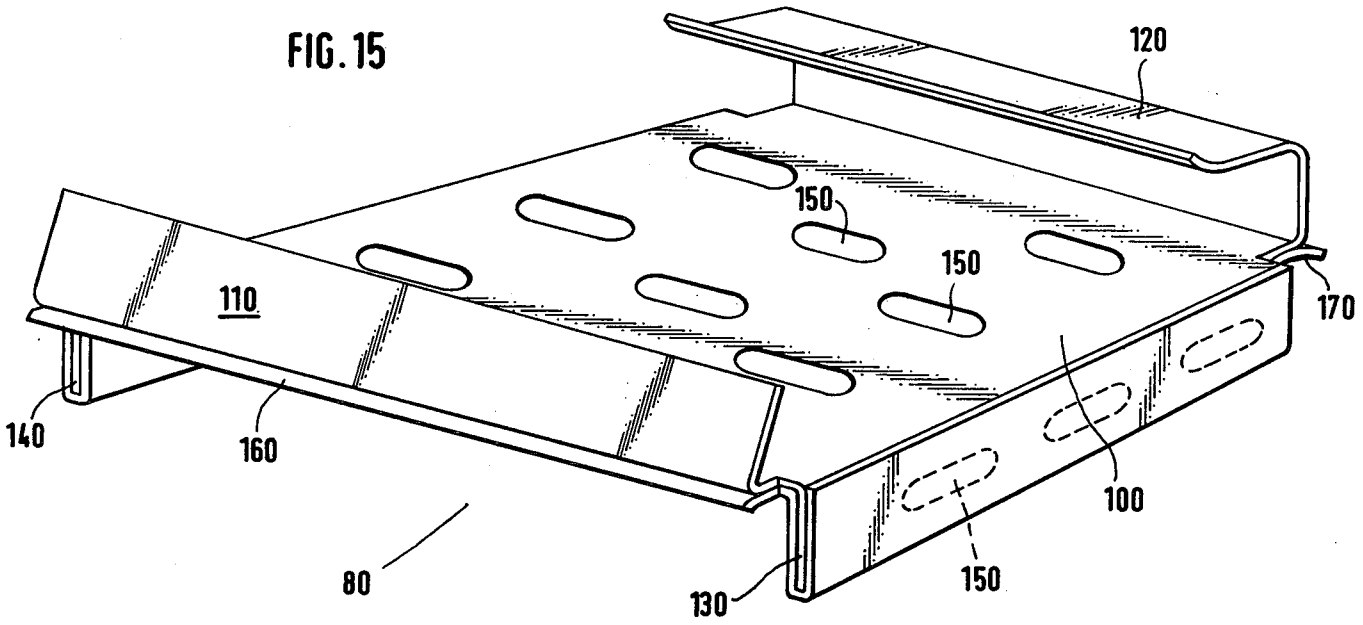
FIG. 15 is a perspective view of a sheet metal frame in the arrangement of FIG. 14.
Figure 16:
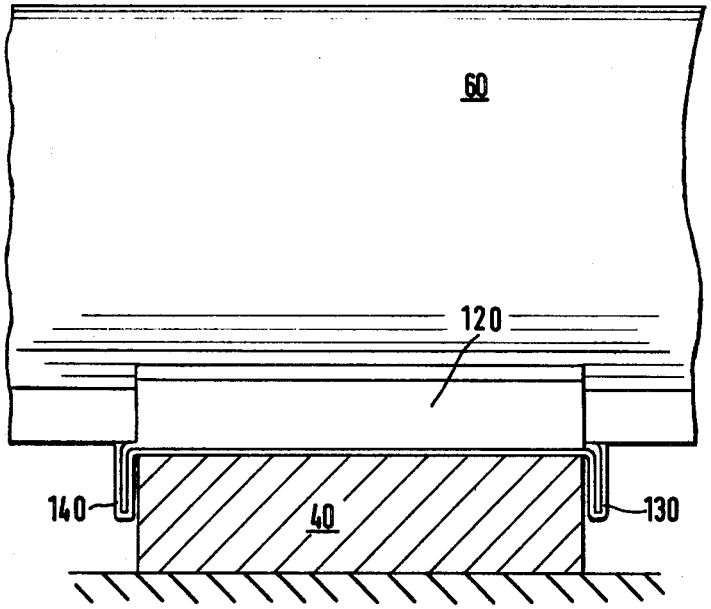
FIG. 16 shows the device of FIG. 14 in fragmentary section on the line XVI—XVI.
Figure 17:
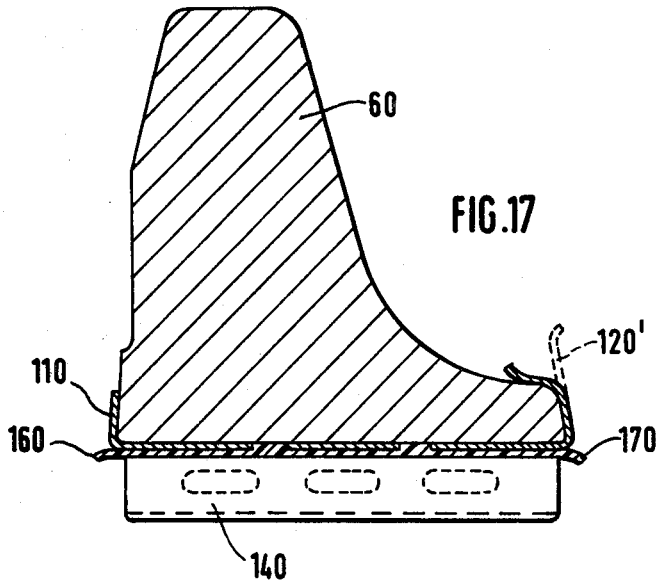
FIG. 17 shows a portion of the apparatus of FIG. 14 in section on a plane spacedly parallel to that of FIG. 14.

The plastic antifriction layer 80 is fastened to the bottom face of the rail blade 60 shown in FIGS. 14 to 17 by a sheet metal frame or receptacle 100 best seen in FIG. 15. Two longitudinal flanges 110, 120 of the frame are bent upward and receive therebetween the base of the blade 60 in conforming, clamping engagement. The flange 120 initially is approximately flat, as seen at 120' in FIG. 17, but its edge portion is offset horizontally after mounting of the frame 100 on the blade 60. Two transverse flanges 130, 140 depend from corresponding edges of the frame 100 for guiding engagement with corresponding edge faces of the associated slide plate 40, as is best seen in FIG. 16.

Elongated openings 150 are formed in the sheet metal of the frame 100 between its two major, horizontal faces and in the inner folds of the dependent flanges 130, 140. The frame 100, before being assembled with the rail blade 60, is set into a mold contoured in such a manner that a synthetic resin composition injected into the mold covers the major bottom face of the frame 100 and the inner faces of the depending flanges 130, 140, thereby also entering the openings 150 and being anchored in the openings when solidified. A plastic sheet 80 is thus interposed between the bottom face of the rail blade 60 and the top face of the slide plate 40, but also between the transverse upright faces of the slide plate and the opposite faces of the flanges 130, 140. Edge portions 160, 170 of the plastic sheet 80 project below the flanges 110, 120 beyond the flanges 130, 140 and are thin enough to be resilient. They sweep the top surface of the slide plate 40 free from particulate matter during each switching movement of the rail blade 60 indicated by an arrow 70.

It should be understood, of course, that the foreging disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. In a rail switch arrangement including a support an elongated rail fixedly mounted on said support, and an elongated rail blade mounted on said support for movement toward and away from a position contiguously adjacent said fixedly mounted rail, said support having a substantially horizontal top face and said blade having a bottom face, the improvement which comprises:

(a) a frame formed with an opening;

(b) fastening means fastening said frame to said bottom face and (c) a sheet member of synthetic resin composition fixedly received in said opening and slidingly engaging said top face during said movement of the rail blade.

2. In an arrangement as set forth in claim 1, said fastening means including two flanges on said frame spaced transversely of the direction of elongation of said rail blade and receiving said rail blade therebetween, and clamping means on one of said flanges for clamping said frame to said rail blade.

3. In an arrangement as set forth in claim 2, said fastening means further including securing means securing said frame on said rail blade against movement in said direction of elongation.

4. In an arrangement as set forth in claim 2, two guide flanges elongated in the direction of said movement of the rail blade, said support including a slide plate movingly received between said guide flanges.

5. In a rail switch arrangement including a support, an elongated rail fixedly mounted on said support, and an elongated rail blade mounted on said support for movement toward and away from a position contiguously adjacent said fixedly mounted rail, said support having a substantially horizontal top face and said blade having a bottom face, the improvement which comprises:

(a) a sheet member of synthetic resin composition fixedly secured to said bottom face and slidingly engaging said top face during said movement of the rail blade; and (b) a resilient wiper blade integrally joined to said sheet member, said wiper blade having a lip portion sweeping said top face during said movement of the rail blade.

6. In an arrangement as set forth in claim 5, said bottom face being formed with a recess, said sheet member being received in said recess.

7. In a rail switch arrangement including a support, an elongated rail fixedly mounted on said support, and an elongated rail blade mounted on said support for movement toward and away from a position contiguously adjacent said fixedly mounted rail, said support having a substantially horizontal top face and said blade having a bottom face, the improvement which comprises:

(a) a receptacle defining a recess therein;

(b) fastening means fastening said receptacle to said bottom face; and (c) a sheet member of synthetic resin composition fixedly secured in said recess and slidingly engaging said top face during said movement of the rail blade.

8. In an arrangement as set forth in claim 7, a wiper blade of resilient material mounted on said rail blade, said wiper blade having a lip portion sweeping said top face during said movement of the rail blade.

9. In an arrangement as set forth in claim 7, said top face having two portions alternatively exposed to the atmosphere during said movement of said rail blade.

10. In an arrangement as set forth in claim 9, said top face consisting of metal.

* * * * *